US006702557B2

(12) United States Patent
Kim et al.

(10) Patent No.: US 6,702,557 B2
(45) Date of Patent: Mar. 9, 2004

(54) VALVE ASSEMBLY PROHIBITING RE-EXPANSION OF RESIDUAL FLUID

(75) Inventors: Gui-gwon Kim, Suwon (KR); Sung-tae Lee, Gwangju (KR); Kyung-tae Jang, Anyang (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 78 days.

(21) Appl. No.: 10/140,152

(22) Filed: May 7, 2002

(65) Prior Publication Data

US 2003/0103855 A1 Jun. 5, 2003

(30) Foreign Application Priority Data

Dec. 3, 2001 (KR) ..... 2001-75757

(51) Int. Cl.[7] ..... F04B 39/10; F04B 23/00
(52) U.S. Cl. ..... 417/570; 417/520; 417/501
(58) Field of Search ..... 417/570, 520, 417/501, 433, 445

(56) References Cited

U.S. PATENT DOCUMENTS 855,050 A * 5/1907 Dietrich ..... 417/501
2,751,146 A * 6/1956 Moseley ..... 417/255
2,819,678 A * 1/1958 Nordell et al. ..... 417/571
3,704,079 A * 11/1972 Berlyn ..... 417/438
4,625,685 A * 12/1986 Beshore ..... 123/50 R
5,549,453 A * 8/1996 Murakami et al. ..... 417/255
5,775,885 A * 7/1998 Dreiman et al. ..... 417/553
5,921,755 A * 7/1999 Eldridge ..... 417/255
6,152,710 A 11/2000 Oh et al.
6,190,143 B1 * 2/2001 Jacobsen et al. ..... 417/269

* cited by examiner

*Primary Examiner*—Charles G. Freay
*Assistant Examiner*—Timothy P. Solatk
(74) *Attorney, Agent, or Firm*—Ladas & Parry

(57) ABSTRACT

A fluid compressing apparatus including a cylinder block having a cylinder bore with a diameter penetrating through the cylinder block in a lengthwise direction, a discharge chamber having a diameter larger than the diameter of the cylinder bore, and at least one fluid suction port penetrating into the cylinder block including an interconnected space comprising a fluid discharge port. A piston serves to open and close the suction port while linearly reciprocating within the cylinder bore eliminating need for a separate suction valve assembly. A valve plate separates from and opens the discharge port as a result of the high pressure of the fluid in the cylinder bore, thus compressing the fluid until completely discharged; such that the clearance volume in the cylinder bore is minimized improving compression efficiency.

20 Claims, 9 Drawing Sheets

VALVE ASSEMBLY PROHIBITING RE-EXPANSION OF RESIDUAL FLUID

BACKGROUND OF THE INVENTION

1. Field of the Invention

The present invention relates generally to a fluid compressing apparatus, and more particularly, to a fluid compressing apparatus for discharging the fluid by a compressing or pumping action utilizing a linear reciprocating movement of a piston.

2. Description of the Related Art

A typical example of a conventional fluid compressing apparatus is shown in FIGS. 1 and 2, which will be described briefly below.

FIGS. 1 and 2 are sectional views that schematically show the structure and operation of the conventional fluid compressing apparatus. The reference numeral 10 indicates a cylinder block, 20 a piston, 30 a valve plate and 40 a cylinder head.

As shown in FIGS. 1 and 2, the cylinder block 10 has a cylinder bore 11 of a predetermined diameter that penetrates through the cylinder block 10 in a lengthwise or longitudinal direction. The piston 20 is movably mounted in the cylinder bore 11 of the cylinder block 10 so as to be capable of reciprocal action, and the valve plate 30 is disposed in the cylinder block 10. The valve plate 30 has fluid suction/discharge ports 31 and 32 formed therein, and suction/discharge valves 33 and 34 (shown in phantom), that can open and cover the fluid suction/discharge ports 31 and 32. The cylinder head 40 is disposed in the cylinder block 10 toward the longitudinal side adjacent the valve plate 30, and the cylinder head 40 has fluid suction/discharge chambers 41 and 42 respectively interconnecting with the fluid suction/discharge ports 31 and 32 of the valve plate 30. The cylinder head 40 is connected to fluid suction/discharge manifolds 43 and 44 that are respectively interconnected with the fluid suction/discharge chambers 41 and 42 of the cylinder head 40.

In the conventional fluid compressing apparatus constructed as described above, and illustrated in FIGS. 1 and 2, a driving force transmitted from a piston driving source (not shown), causes the piston 20 to reciprocate within the cylinder bore 11 of the cylinder block 10, thereby causing the fluid to be drawn in, compressed and discharged.

Additionally, as the piston 20 moves from the top dead end point T (FIG. 1) to the bottom dead end point B (FIG. 2) of the cylinder bore 11, due to the different pressures in and out of the cylinder bore 11, the suction valve 33 opens the suction port 31 of the valve plate 30 (as shown in phantom in FIG. 2), and accordingly, the fluid is drawn into the cylinder bore of the cylinder block 10 sequentially through the suction manifold 43, the suction chamber 41 of the cylinder head 40 and the suction port 31 of the valve plate 30. At this time, the pressure in the discharge chamber 42 of the cylinder head 40 is higher than the pressure in the cylinder bore 11 so that the discharge valve 34 maintains the discharge port 32 closed.

Meanwhile, as the piston 20 is returned from the bottom dead end point B (FIG. 2) to the top dead end point T (FIG. 1), the fluid in the cylinder bore 11 is gradually compressed. Finally, when the piston 20 reaches the top dead end point T, as shown in FIG. 1, the pressure in the cylinder bore 11 becomes higher than the pressure in the discharge chamber 42 of the cylinder head 40, and accordingly, as shown in phantom in FIG. 1, the discharge valve 34 opens the discharge port 32 of the valve plate 30, and the compressed fluid is discharged through the discharge port 32 of the valve plate 30, the discharge chamber 42 of the cylinder head 40 and the discharge manifold 44. At this time, the pressure in the suction chamber 41 is lower than the pressure in the cylinder bore 11, and thus, the suction valve 33 maintains the suction port 31 closed.

Then, when the piston 20 moves back to the bottom dead end point B, the suction port 31 is opened by the suction valve 33, whereas the discharge port 32 is closed by the discharge valve 34. As a result, the fluid is drawn into the bore 11. Then as the piston 20 is moved to the top dead end point T, the drawn air is compressed and then discharged through the discharge port 32. As this reciprocating movement of the piston 20 repeats, the compression and discharge of the fluid also repeats the cycle described above.

In the conventional fluid compressing apparatus described above, however, the compressed fluid is often incompletely discharged, which retains some residual fluid at the discharge port 32 of the valve plate 30. Such residual fluid re-expands during the fluid suctioning process in which the piston 20 is moved from the top dead end point T to the bottom dead end point B. The problem arises in the initial fluid suctioning process where the piston 20 is moved toward the bottom dead end point B. That is, due to the presence of re-expanding residual fluid, the pressure in the cylinder bore 11 is initially higher than the pressure in the suction chamber 41, although the pressure in the cylinder bore 11 is lower than the pressure in the discharge chamber 42 of the cylinder head 40. Accordingly, the suctioning does not occur at the beginning of the stroke of the piston 20 toward the bottom dead end point B. Then the suction valve 33 is opened to draw in the fresh fluid when the pressure in the cylinder bore 11 becomes lower than the pressure in the suction chamber 41, which is obtained only when the piston 20 moves toward the bottom dead end point B for a sufficient period of time. In other words, the residual fluid from the fluid compression and discharge in the conventional fluid compressing apparatus causes a clearance volume in the cylinder bore 11 that makes a certain space in the cylinder bore 11 unavailable. Accordingly, the amount of drawn fluid decreases, and pumping efficiency deteriorates considerably.

Further, due to the complicated structure that is used for the suction valve 33 and the discharge valve 34 for opening/closing the fluid suction port 31 and discharge port 32, the conventional apparatus is difficult to assemble and productivity thus deteriorates, and manufacturing costs increase considerably.

SUMMARY OF THE INVENTION

The present invention has been made to overcome the above-mentioned problems of the related art, and accordingly, it is an object of the present invention to provide a fluid compressing apparatus for increasing pumping efficiency by discharging compressed fluid completely out of the bore and thus minimizing clearance volume in the cylinder bore.

Another object is to provide a fluid compressing apparatus having a simple structure and being easy to assemble and thereby increasing productivity and reducing manufacturing costs, by using a piston to open and close a fluid suction port, thereby omitting a need to use a separate suction valve device, and providing a discharge valve device having a simple structure.

The above objects are accomplished by providing a fluid compressing apparatus according to the present invention, including a cylinder block having a cylinder bore of a predetermined diameter penetrating through the cylinder block in a lengthwise direction, a discharge chamber having a diameter larger than the diameter of the cylinder bore, and at least one fluid suction port penetrating in the cylinder block in a substantially perpendicular direction with respect to the cylinder bore, the cylinder block using a certain space thereof that is interconnected with the discharge chamber of the cylinder borer as a fluid discharge port; a piston movably disposed in the cylinder bore of the cylinder block to be linearly reciprocated; a discharge valve assembly having a valve plate disposed to be resiliently biased from the discharge chamber toward the fluid discharge port so as to selectively open or close the fluid discharge port of the cylinder block; and a cylinder head disposed at an end of the discharge chamber of the cylinder block, and having a fluid discharge channel interconnected with the discharge chamber.

According to the present invention, the fluid is drawn when the fluid suction port is selectively opened by the linear reciprocation of the piston within the cylinder bore of the cylinder block, and discharged when the fluid discharge port is opened by the valve plate that is separated from the fluid discharge port by the high pressure of the fluid in the cylinder bore caused by the reciprocating piston. Since suction valves having complicated structure are omitted, ease of assembly and improved productivity are achieved, and manufacturing costs are reduced. Also, since the high pressure fluid, compressed in the cylinder bore, is discharged through the fluid discharge port completely, a clearance volume in the cylinder bore can be avoided or minimized, and thus, the compression efficiency is enhanced.

In the fluid compressing apparatus according to the preferred embodiment of the present invention, a top dead end point of the piston is slightly beyond an extreme end of the cylinder bore, thereby discharging the fluid compressed in the cylinder bore completely when the piston contacts the valve plate.

The fluid suction port is positioned adjacent a bottom dead end point of the piston, i.e., adjacent to an extreme end point for the movement of the piston, so that the fluid suction port is instantly opened when the piston reaches the bottom dead end point and a fluid is drawn rapidly through the open fluid suction port.

The discharge valve assembly includes the valve plate disposed to be separable and floatable from the fluid discharge port of the cylinder block, and having a first boss formed approximately at a center of one side; a supporting plate disposed in the discharge chamber of the cylinder block at a predetermined distance from the valve plate, the supporting plate having a second boss formed at one side corresponding to the first boss, and a plurality of fluid passages formed around the second boss in a radial direction; and an resilient member disposed between the valve plate and the supporting plate, for resiliently biasing the valve plate toward the fluid discharge port.

The cylinder block has a circular or a rectangular outer structure. Two fluid suction ports can be provided to the cylinder block and these may be diametrically opposed to each other. Alternatively, more than two fluid suction ports can be provided to the cylinder block disposed at a predetermined space from each other.

The fluid suction port can be tapered, or formed into a double-layered structure consisting of a large diameter portion and a smaller diameter portion, or formed as a combination of the tapered and double-layered structure.

The area of the fluid suction port utilized for drawing the fluid is preferably widened by cutting away at least a certain portion of the cylinder block, for more efficient drawing of the fluid.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

The preferred embodiment of the present invention will now be described with reference to the drawings.

Figure 1:
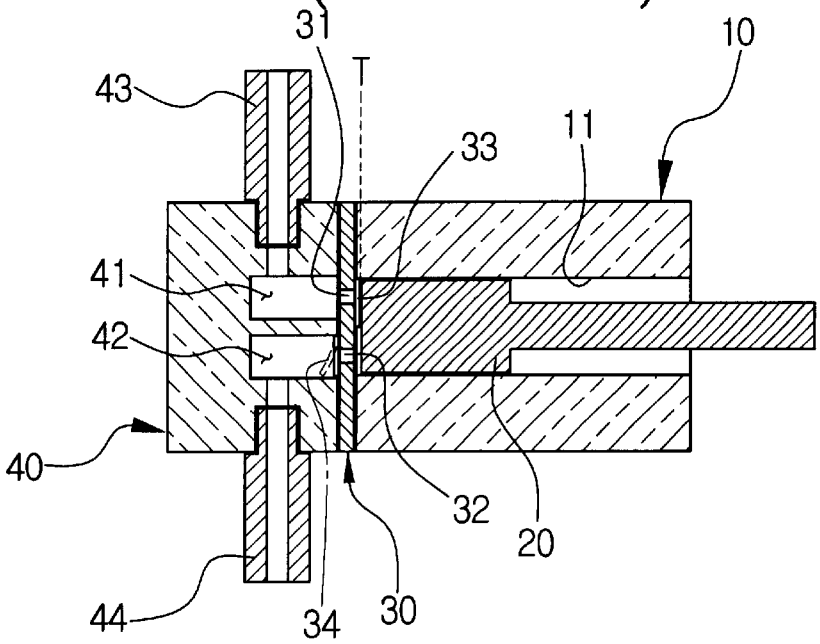
FIG.1 (PRIOR ART)
FIGS. 1 and 2 are sectional views schematically showing the structure and operation of a conventional fluid compressing apparatus.
Figure 2:
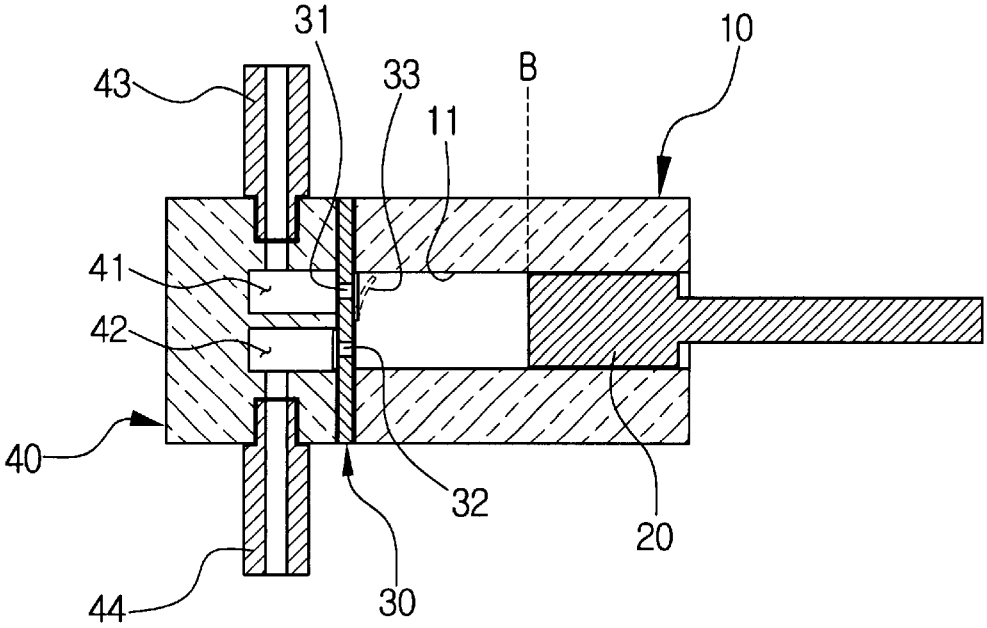
FIG.2 (PRIOR ART)
Figure 3:
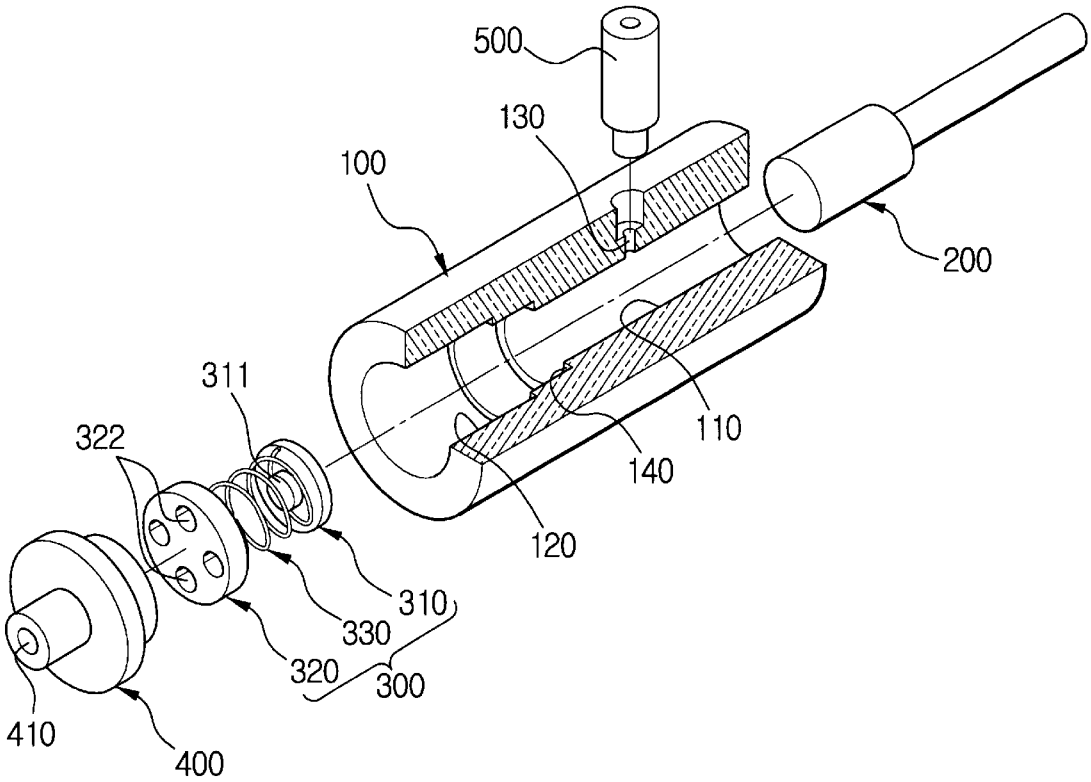
FIG. 3 is an exploded perspective partially cutaway view of a fluid compressing apparatus according to a preferred embodiment of the present invention.

FIG. 3 is an exploded perspective view, shown in partial cutaway cross-section, of a fluid compressing apparatus according to the preferred embodiment of the present invention, and FIGS. 4 through 7 are sectional views for explaining the structure and operation of the fluid compressing apparatus of FIG. 3.

As shown in FIGS. 3 through 7, the fluid compressing apparatus according to the preferred embodiment of the present invention includes a cylinder block 100, a piston 200, a discharge valve assembly 300 and a cylinder head 400.

The cylinder block 100 includes a cylinder bore 110 of a predetermined diameter penetrated through the cylinder block 100 in a lengthwise direction, a discharge chamber 120 having a diameter larger than the diameter of the cylinder bore 110, and at least one fluid suction port 130 penetrated through the cylinder block 100 in a direction perpendicular to longitudinal extension of the cylinder bore 110. The space interconnecting with the discharge chamber 120 in the cylinder bore 110 is used as a compressed fluid discharge port 140.

Figure 8A:
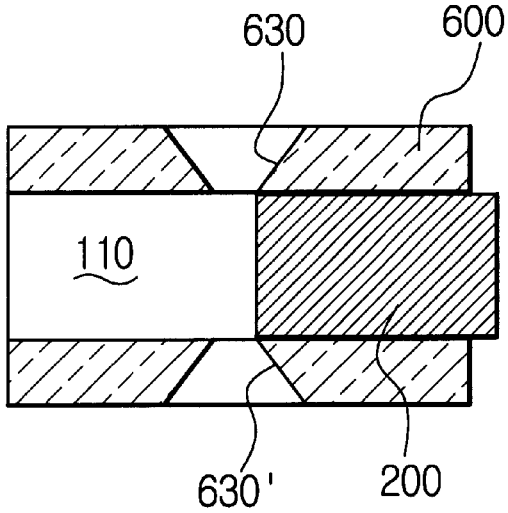
FIGS. 8A through 8G are cross-sectional and perspective views showing various embodiments of the cylinder block and fluid suction port of the fluid compressing apparatus according to the present invention.
Figure 8B:
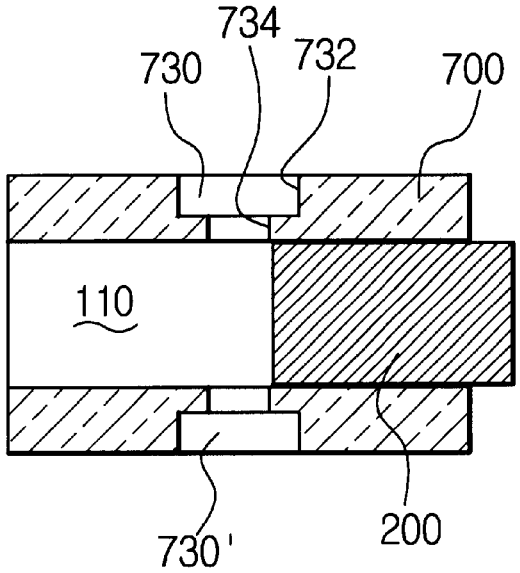
Figure 8C:
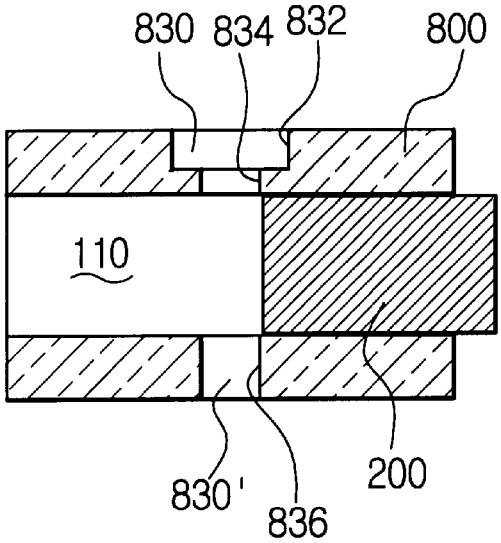
Figure 8D:
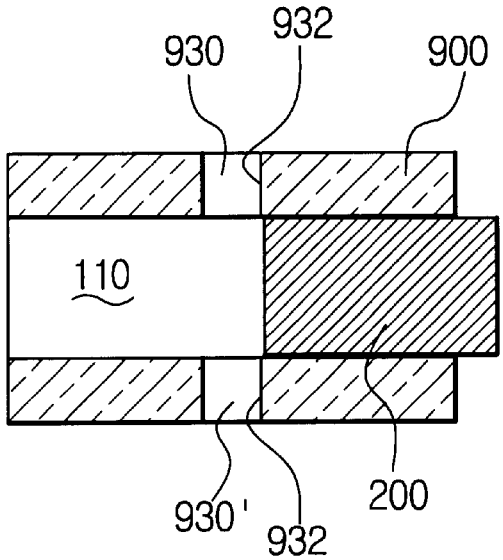
Figure 8E:
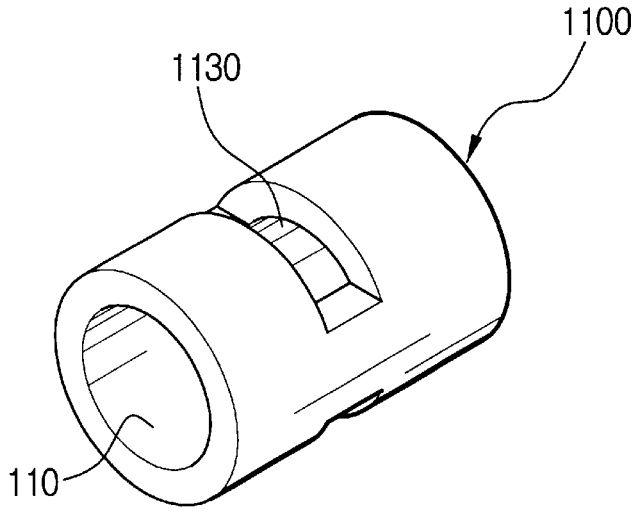
Figure 8F:
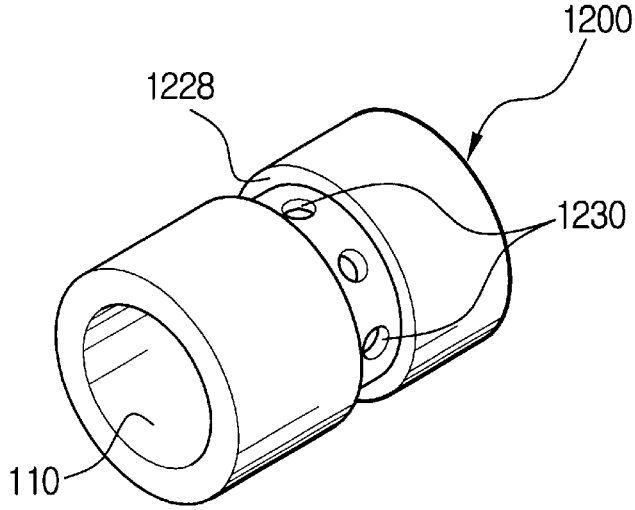
Figure 8G:
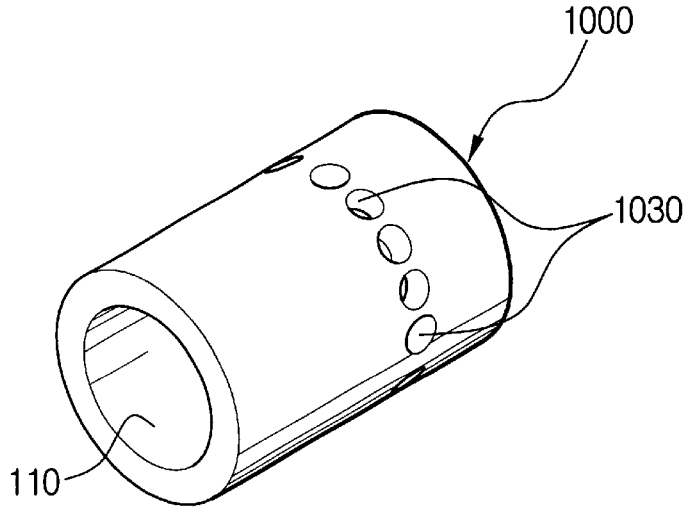
Figure 9:
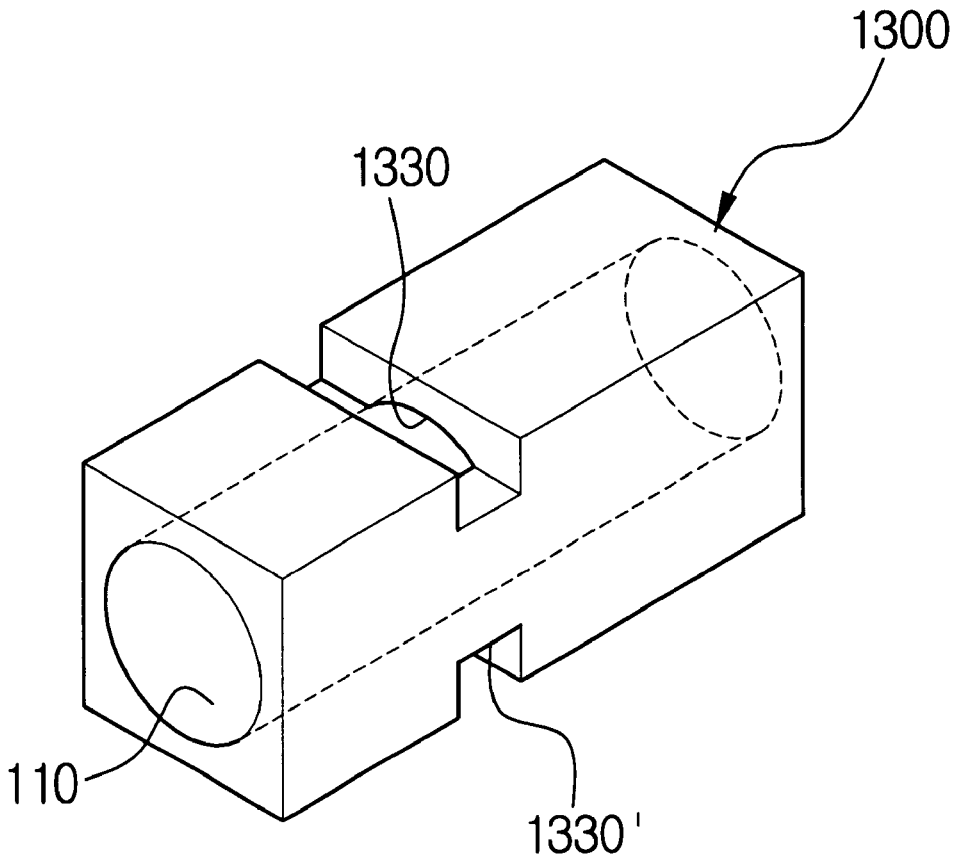
FIG. 9 is a perspective view showing another embodiment of the cylinder block and the fluid suction port of the fluid compressing apparatus according to the present invention.

The cylinder block 100 can have a cylindrical outer structure as shown in FIGS. 8A through 8G, or a rectangular outer structure as shown in FIG. 9. The shape of the cylinder block 100 is capable of taking any practical form. In other words, the shape of the outer structure of the cylinder block 100 is not limited to the certain shapes illustrated and described herein.

As best shown in FIG. 3, the discharge chamber 120 is of a double-layered structure in which separate sections having different diameters are formed adjacent each other. However, this structure is not strictly limited, and feasible modifications can be made. For example, some of the sections could have a uniform diameter, as shown, for example, in FIG. 8D.

In this embodiment, although the fluid suction port 130 is formed in a direction perpendicular to the longitudinally extending cylinder bore 110, this structure is not strictly limited to the illustrated embodiment only. Accordingly, if it is more advantageous in terms of desired flow rate and structure, the fluid suction port 130 can be formed at a certain angle (inclusive of acute and obtuse angles) with respect to the cylinder bore 110.

The piston 200 is disposed to linearly reciprocate within the cylinder bore 110 of the cylinder block 100. With the driving force transmitted from a separate driving source (not shown), the piston 200 linearly reciprocates within the cylinder bore 110 to thereby draw and compress the fluid. In order to reduce load to the piston 200, the piston 200 is designed to be a hollow cylinder, and more preferably, to be made of an aluminum alloy.

The discharge valve assembly 300 is elastically biased from the discharge chamber 120 of the cylinder block 100 toward the fluid discharge port 140, to selectively open or close the fluid discharge port 140 of the cylinder block 100. The discharge valve assembly 300 has a valve plate 310 having a diameter slightly larger than the diameter of the fluid discharge port 140.

The valve plate 310 is supported such that it is not rigidly attached to the bore 110, but can float relative to the fluid discharge port 140. The valve plate 310 has a first boss 311 formed approximately at the center of a rear surface, opposite to the surface facing the discharge port 140. Further, the discharge valve assembly 300 includes a supporting plate 320 disposed at the rear end of the discharge chamber 120 at a predetermined space from the valve plate 310, and a resilient member 330 disposed between the valve plate 310 and the supporting plate 320 to resiliently urge the valve plate 310 toward the fluid discharge port 140. Accordingly, when the cylinder bore 110 is not subject to pressure, i.e., during the fluid suctioning process, the valve plate 310 is urged toward close contact with the fluid discharge port 140, thereby closing off the fluid discharge port 140. Then as the cylinder bore 110 is subject to a growing pressure, i.e., during the fluid compressing process, the valve plate 310 overcomes the resistance of the resilient member 330 and as a result of the high pressure of the fluid in the cylinder bore 110, causes the valve plate 310 to separate from and open the fluid discharge port 140, thereby letting the fluid out.

The supporting plate 320 has a second boss 321 formed approximately at the center thereof, corresponding to and oppositely facing the first boss 311. Three or more fluid passages 322 preferably are formed around the second boss 321 at a predetermined distance from each other and may be disposed in a radial direction. The supporting plate 320 can be secured to the discharge chamber 120 of the cylinder block 100 by appropriate fastening methods, such as screwing or welding.

The resilient member 330, may comprise a compression coil spring. When using the compression coil spring, the spring is supported at each end and disposed around the first and the second bosses 311 and 321 formed on the valve plate 310 and the supporting plate 320, respectively. Instead of the compression coil spring, other types of resilient member can also be used, for example, a flat spring, or even a magnetic repelling mechanism.

The cylinder head 400 is disposed at the end of the discharge chamber 120 of the cylinder block 100, and has a fluid discharge channel 410 that is preferably formed at the center and is interconnected with the discharge chamber 120. There is no absolutely prescribed shape or structure of forming the cylinder head 400. A connecting means, such as a screw, is employed in this embodiment to connect the cylinder head 400 to the chamber 120.

As shown in each of FIGS. 3 through 7, a fluid suction manifold 500 provides a means for introducing new fluid to the compressing apparatus.

In the fluid compressing apparatus constructed as described above according to the present invention, the fluid suction port 130 is selectively opened by the piston 200 that linearly reciprocates within the cylinder bore 110. Due to a vacuum that is developed in the cylinder bore 110, the fluid is drawn in rapidly, and due to the high pressure of the fluid developed in the cylinder bore 110, the valve plate 310 floats so as to separate from the fluid discharge port 140, thereby opening the fluid discharge port 140 and enabling complete discharge of the fluid.

Figure 4:
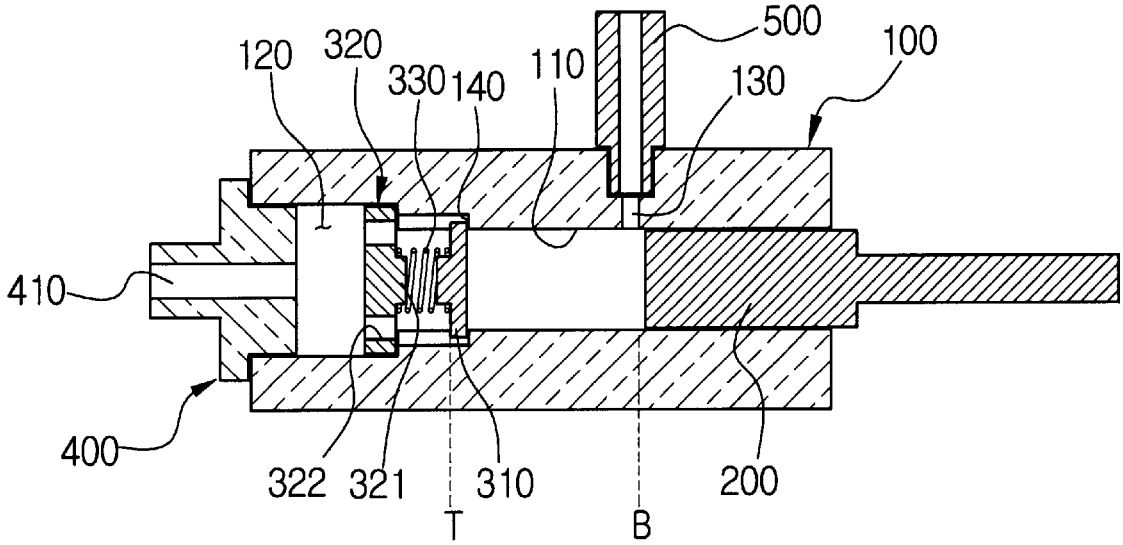
FIGS. 4 through 7 are sectional views showing the structure and operation of the fluid compressing apparatus according to a preferred embodiment of the present invention.

The characteristic and the structure that enables the unique effect of the present invention is that, as shown in FIG. 4, the top dead end point T of the piston 200 is disposed slightly beyond the extreme end of the cylinder bore 110. Accordingly, the first unique effect of the present invention is that the compressed fluid within the cylinder bore 110 is completely discharged when the piston 200 contacts with and longitudinally displaces the valve plate 310. Unlike the conventional compressor, the structure according to the present invention allows no residual fluid in the cylinder bore 110, and as a result, any clearance volume is prevented or minimized.

The characteristic and the structure that enables the second unique effect of the present invention is that the fluid suction port 130 is formed slightly before the extreme rear end point of the cylinder bore 110, i.e., before the bottom dead end point B reached by the piston 200, and that the piston 200 serves to selectively open the fluid suction port 130 while reciprocating in the cylinder bore 110 omitting a need to use a separate suction valve assembly. When the piston 200 reaches the bottom dead end point B, the fluid suction port 130 is suddenly opened, and fresh fluid is rapidly drawn into the cylinder bore 110 since it is in a vacuum state. Since there is no need to employ a complicated suction valve assembly, the structure is simplified. Also, since the fluid is drawn rapidly, there arises a cooling effect of the cylinder block 100.

Meanwhile, in the fluid compressing apparatus according to the present invention, since the fluid is drawn through the fluid suction port 130 when the fluid suction port 130 is suddenly opened by the movement of the piston 200, the amount of the drawn fluid can sometimes be insufficient. Taking this into account, some embodiments of the present invention may include at least two fluid suction ports 130 and 130' formed diametrically opposite each other in the cylinder block 100, enabling drawing of the fluid in greater amounts (See FIGS. 8A through 8H).

According to another embodiment of the present invention, shown in FIG. 8A, the fluid suction ports 630 and 630' are tapered to have a gradually decreasing diameter from outside to the inside of the cylinder block 600. Alternatively, the fluid suction ports 730 and 730' may be formed in double layers having large-diameter space 732 and a smaller-diameter space 734 as shown in FIG. 8B. Also, one fluid suction port 830 can be formed in a double-layered structure having a large-diameter space 832 and a smaller-diameter space 834, while the other fluid suction port 830' is formed as a hole of a predetermined diameter 836, as shown in FIG. 8C. Also, both of the fluid suction ports 930 and 930' may be formed as holes of predetermined diameters 932, as shown in FIG. 8D. Also, in another embodiment 890, one fluid suction port 680 can be tapered to have a gradually decreasing diameter from outside to the inside of the cylinder block structure, while the other fluid suction port 880 is formed as a double-layered structure having a large-diameter space 882 and a smaller-diameter space 884, as shown in FIG. 8H.

Figure 8H:
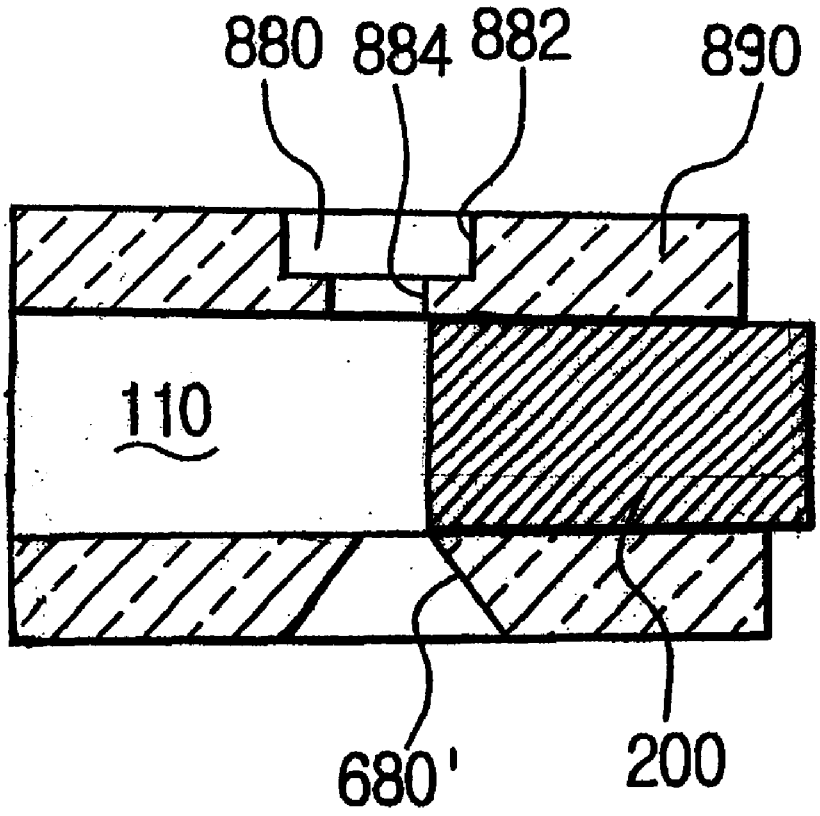

According to still another embodiment of the present invention, a plurality of fluid suction ports 1030 are formed over the entire outer circumference of the cylinder block 1000 in order to ensure a greater area for drawing the fluid, as shown in FIG. 8G.

Alternatively, as shown in FIG. 8E, the area 1130 for drawing the fluid is widened by cutting out a certain portion of the cylinder block 1100. FIG. 8F shows still another embodiment, in which a cutaway portion 1228 having a predetermined width and a predetermined depth is formed along the outer circumference of the cylinder block 1200, and a plurality of fluid suction ports 1230 are formed in the cutaway portion at a predetermined distance from each other.

FIG. 9 shows still another embodiment of the present invention. As shown in FIG. 9, the cylinder block 1300 according to this embodiment of the present invention has a rectangular outer structure, and fluid suction ports 1330 and 1330' formed in one or two cutaway portion formed in the rectangular cylinder block 1300. In this embodiment, the area for the fluid suction ports is increased, and accordingly, the drawing of fluid into the cylinder bore becomes more efficient.

The operation of the fluid compressing apparatus constructed as above described according to the present invention will be generally described with reference to FIGS. 4 through 7. Although only the operation of only one embodiment is shown and described, the operation is similar with respect to each of the above-described embodiments.

FIG. 4 shows the piston 200 in the cylinder bore 110 completely displaced to the bottom dead end point B. As shown in FIG. 4, when the piston 200 is displaced to the bottom dead end point B, the fluid suction port 130, which was closed by the piston 200, is opened, letting the fluid into the cylinder bore 110 therethrough. More specifically, the fluid discharge port 140 of the cylinder bore 110 is in the closed state when the piston 200 starts moving from the top dead end point T to the bottom dead end point B. With the fluid discharge port 140 of the cylinder bore 110 in the closed state, and with the fluid suction port 130 being closed by the piston 200, a vacuum is produced in the cylinder bore 10 when the piston 200 is forced to move to the bottom dead end point B by the exterior driving source (not shown). The suction force becomes greater as the piston 200 moves closer to the bottom dead end point B. Then when the piston 200 finally reaches the bottom dead end point B, opening the fluid suction port 130, the fluid is rapidly drawn through the fluid suction port 130 into the cylinder bore 110.

Figure 5:
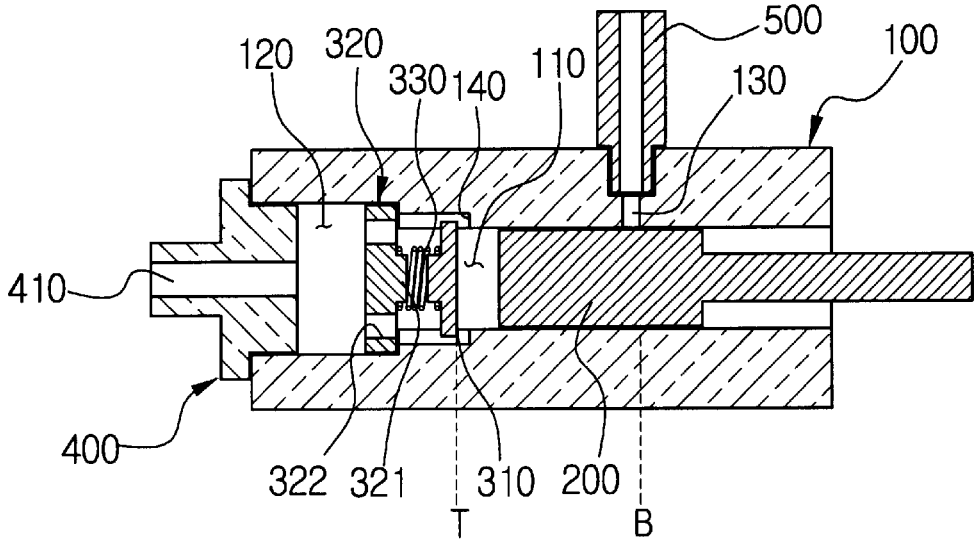

FIG. 5 shows the piston 200 moving toward the top dead end point T after returning from the bottom dead end point B, and thus compressing the fluid that was drawn into cylinder bore 110. As the piston 200 moves, the fluid suction port 130 is closed, and due to the resistance of the resilient member 330 disposed on the opposite side of the valve plate 310, the valve plate 310 keeps close contact with the fluid discharge port 140 and thus closes off the fluid discharge port 140. With the fluid suction port 130 and the fluid discharge port 140 being closed, the drawn fluid is gradually compressed as the piston 200 is forced to move to the top dead end point T.

Figure 6:
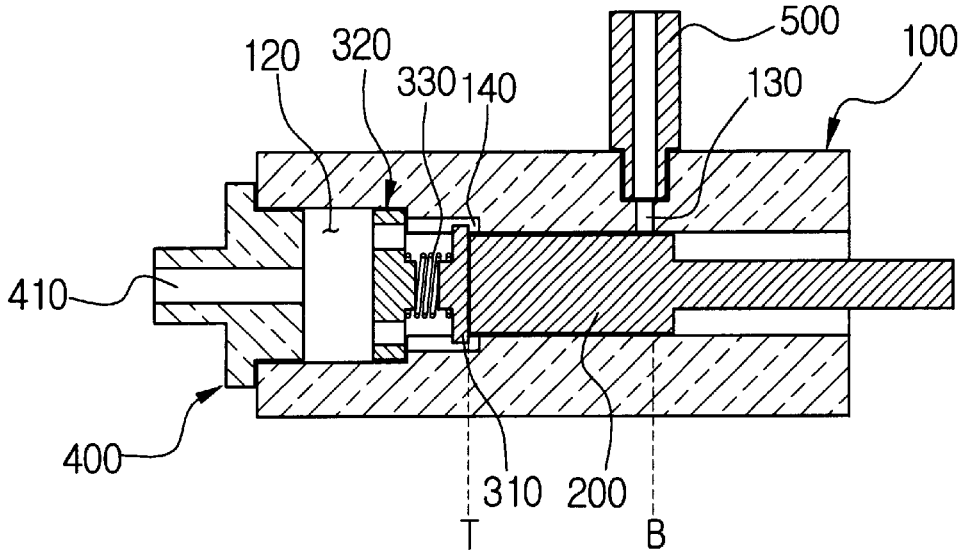

FIG. 6 shows the piston 200 in the position where it is reaching the top dead end point T. The fluid that was previously drawn into the cylinder bore 110 is gradually compressed as the piston 200 moves closer to a certain point. Then as the piston 200 reaches the end point T, the imbalance between the pressure of the fluid and the resistance of the resilient member 330 resiliently supporting the valve plate 310 (i.e., pressure of fluid is greater than the resistance of the resilient member causes the valve plate 310 to separate and float from the fluid discharge port 140, and accordingly, the high-pressure fluid is discharged completely from the cylinder bore 110 into the discharge chamber 120 through the open fluid discharge port 140. The piston 200 comes into contact with the valve plate 310 at the instant that the last amount of fluid is just about to be discharged. The last amount of the higher-pressure fluid serves as a buffer against the collision of the piston 200 and the valve plate 310, before it is finally discharged to the discharge chamber 120 when the piston 200 passes the extreme end of the cylinder bore 110 and reaches the top dead end point T. Since there is no residual fluid in the cylinder bore 110 after the piston 200 reaches the top dead end point T, ideally no clearance volume remains in the cylinder bore 110.

Figure 7:
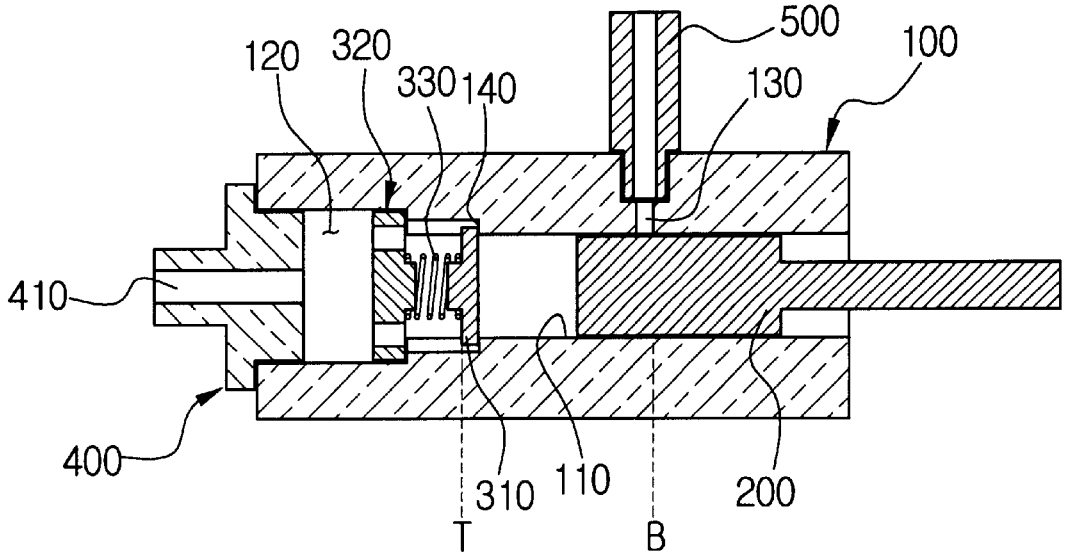

FIG. 7 shows the piston 200 returning from the top dead end point T toward the bottom dead end point B after the compression of the fluid. As shown in FIG. 7, almost simultaneously with the piston 200 moving toward the bottom dead end point B, the valve plate 310 is pressed into close contact with the fluid discharge port 140 by the resilient member 330 to close the fluid discharge port 140. Also, the fluid suction port 130 is closed by the piston 200. As the piston 200 moves closer to the bottom dead end point B, the degree of vacuum in the cylinder bore 110 increases with increasing volume defined by the walls of cylinder bore 110 and the end wall of the piston 200. Then, as the piston 200 reaches the bottom dead end point B, as shown in FIG. 4, the fluid suction port 130 is opened, and accordingly, fresh fluid is rapidly drawn into the cylinder bore 110 through the fluid suction port 130 by the suction force of the vacuum in the cylinder bore 110. The compression and drawing of the fluid repeats sequentially so that the fluid is drawn in, compressed and discharged continuously.

Although the fluid compressing apparatus, which draws and compresses the fluid (gas in this embodiment) into high pressure and discharges the high-pressure fluid, is particularly used in this embodiment as a way of example, those skilled in the art would note that the present invention can also be applied to a fluid pumping apparatus, for example, to a pump.

As described above, according to the present invention, since there is no compressed high-pressure fluid remaining in the cylinder bore 110, clearance volume in the cylinder bore is minimized. As a result, the compression efficiency increases, and thus it would considerably increase the cooling or freezing efficiency when applied into a compressor of a refrigerator or air conditioner.

Further, according to the present invention, the suction valves having complicated structure are omitted and the inventive discharge valve is formed having simple construction. Accordingly, the structure of the compressor becomes simplified, and the compressor also becomes easy to assemble, resulting in improved productivity and reduction in manufacturing cost.

Further, according to the present invention, the suction valve is omitted and the operation of the discharge valve is improved, and the noise, which is generated in conventional compressors due to beating of the valve, is prevented. As a result, operation of the compressor is quieter.

In conclusion, according to the present invention, a compressor of a pump of high compression efficiency and reliability and simple structure is provided with enhanced ease of assembly and improved productivity at an economic cost.

While the invention has been shown and described with reference to the preferred embodiments thereof, it will be understood by those skilled in the art that various changes in form and details may be made therein without departing from the sprit and scope of the invention as defined by the appended claims.

What is claimed is:

1. A fluid compressing apparatus for drawing, compressing and discharging a fluid, comprising:

a cylinder block having:

a cylinder bore of a predetermined diameter penetrating through the cylinder block in a lengthwise direction, a discharge chamber having a diameter larger than the diameter of the cylinder bore, and at least one fluid suction port penetrating in the cylinder block in a substantially perpendicular relation with respect to the cylinder bore, the cylinder block using a certain space thereof that is interconnected with the discharge chamber of the cylinder bore as a fluid discharge port;

a piston movably disposed in the cylinder bore of the cylinder block to be linearly reciprocated;

a discharge valve assembly having a valve plate disposed to be resiliently biased from the discharge chamber toward the fluid discharge port so as to selectively open or close the fluid discharge port of the cylinder block, wherein the valve plate is able to separate from and float free of the fluid discharge port of the cylinder block, and a supporting plate is disposed in the discharge chamber of the cylinder block at a predetermined distance from the valve plate, the supporting plate having a plurality of fluid passages, and a resilient member disposed between the valve plate and the supporting plate, for resiliently biasing the valve plate toward the fluid discharge port; and a cylinder head disposed at an end of the discharge chamber of the cylinder block, and having a fluid discharge channel interconnected with the discharge chamber, wherein the cylinder bore receives the fluid that is drawn in, as the fluid suction port is selectively opened, by the piston linearly reciprocating within the cylinder bore, and the fluid is discharged through the open fluid discharge port when the valve plate floats from the fluid discharge port due to high pressure of the fluid in the cylinder bore caused by the reciprocating piston.

2. The fluid compressing apparatus of claim 1, wherein the piston is moved to a top dead end point of the piston slightly beyond an extreme end of the cylinder bore, thereby discharging the fluid compressed in the cylinder bore completely when the piston contacts the valve plate.

3. The fluid compressing apparatus of claim 1, wherein the fluid suction port is positioned adjacent to a bottom dead end point of the piston, at an extreme end for movement of the piston, so that the fluid suction port is instantly opened when the piston reaches the bottom dead end and fluid is drawn through the open fluid suction port.

4. The fluid compressing apparatus of claim 3, wherein the cylinder block has a rectangular outer structure.

5. The fluid compressing apparatus of claim 4, wherein an area of the fluid suction port for drawing the fluid is widened by cutting away at least one side of the cylinder block.

6. The fluid compressing apparatus of claim 5, wherein at least two fluid suction ports are provided being formed on opposite radial sides of the cylinder block.

7. The fluid compressing apparatus of claim 3, wherein the cylinder block is provided with a cutaway portion having a predetermined width and a predetermined depth formed along an outer circumference of the cylinder block, and a plurality of fluid suction ports are formed in the cutaway portion, and the plurality of fluid suction ports comprise holes of a predetermined diameter being arranged at a predetermined distance from each other.

8. The fluid compressing apparatus of claim 7, wherein at least two cutaway portions are provided being formed at opposite radial sides of the cylinder block and at least one fluid suction port formed in each cutaway portion.

9. The fluid compressing apparatus of claim 3, wherein the cylinder block has a circular outer structure.

10. The fluid compressing apparatus of claim 9, wherein the cylinder block is provided with a cutaway portion having a predetermined width and a predetermined depth formed along an outer circumference of the cylinder block, and a plurality of fluid suction ports are formed in the cutaway portion, and the plurality of fluid suction ports comprise holes of a predetermined diameter being arranged at a predetermined distance from each other.

11. The fluid compressing apparatus of claim 9, wherein a plurality of fluid suction ports are provided and the plurality of fluid suction ports being arranged along an outer circumference of the cylinder block at a predetermined distance from each other.

12. The fluid compressing apparatus of claim 11, wherein the fluid suction port is formed as a hole having a predetermined diameter.

13. The fluid compressing apparatus of claim 9, wherein an area of the fluid suction port for drawing the fluid is widened by cutting away a certain portion of the cylinder block.

14. The fluid compressing apparatus of claim 13, wherein at least two fluid suction ports are provided being formed at opposite radial sides of the cylinder block.

15. The fluid compressing apparatus of claim 9, wherein plural fluid suction ports are provided in the cylinder block oppositely disposed to each other.

16. The fluid compressing apparatus of claim 15, wherein the fluid suction port is tapered having a gradually decreasing diameter as measured at radial positions from outside toward inside of the cylinder block.

17. The fluid compressing apparatus of claim 15, wherein the fluid suction port is formed into a double-layered structure consisting of a large diameter portion and a smaller diameter portion.

18. The fluid compressing apparatus of claim 15, wherein one of the two fluid suction ports is formed into a double-layered structure consisting of a large diameter portion and a smaller diameter portion, while the other one is tapered to have a gradually decreasing diameter from outside to inside.

19. A fluid compressing apparatus for drawing, compressing and discharging a fluid, comprising:

a cylinder block having:

a cylinder bore of a predetermined diameter penetrating through the cylinder block in a lengthwise direction, a discharge chamber having a diameter larger than the diameter of the cylinder bore, and at least one fluid suction port penetrating in the cylinder block in a substantially perpendicular relation with respect to the cylinder bore, the cylinder block using a certain space thereof that is interconnected with the discharge chamber of the cylinder bore as a fluid discharge port;

a piston movably disposed in the cylinder bore of the cylinder block to be linearly reciprocated;

a discharge valve assembly having a valve plate disposed to be resiliently biased from the discharge chamber toward the fluid discharge port so as to selectively open or close the fluid discharge port of the cylinder block, wherein the valve plate is able to separate from and float free of the fluid discharge port of the cylinder block, and having a first boss formed approximately at a center of one sides, a supporting plate disposed in the discharge chamber of the cylinder block at a predetermined distance from the valve plate, the supporting plate having a second boss formed at one side substantially corresponding to the first boss, and a plurality of fluid passages formed around the second boss, and a resilient member disposed between the valve plate and the supporting plate, for resiliently biasing the valve plate toward the fluid discharge port; and a cylinder head disposed at an end of the discharge chamber of the cylinder block, and having a fluid discharge channel interconnected with the discharge chamber, wherein the cylinder bore receives the fluid that is drawn in as the fluid suction port is selectively opened by the piston linearly reciprocating within the cylinder bore, and the fluid is discharged through the open fluid discharge port when the valve plate floats from the fluid discharge port due to high pressure of the fluid in the cylinder bore caused by the reciprocating piston.

20. The fluid compressing apparatus of claim 19, wherein the resilient member comprises compression coil spring.

* * * * *